US007287451B2

(12) United States Patent
Rodgers

(10) Patent No.: US 7,287,451 B2
(45) Date of Patent: Oct. 30, 2007

(54) MULTIPLE BIT SCREWDRIVER

(75) Inventor: Aubrey J. Rodgers, Surrey (CA)

(73) Assignee: Kinpack Polyethylene Ltd., Burnaby (CA)

( * ) Notice: Subject to any disclaimer, the term of this patent is extended or adjusted under 35 U.S.C. 154(b) by 226 days.

(21) Appl. No.: 11/075,935

(22) Filed: Mar. 8, 2005

(65) Prior Publication Data

US 2006/0201290 A1 Sep. 14, 2006

(51) Int. Cl.
*B25G 1/08* (2006.01)
*B25B 23/16* (2006.01)
*B25B 15/00* (2006.01)

(52) U.S. Cl. ..... 81/439; 81/177.4; 81/490

(58) Field of Classification Search ..... 81/177.4, 81/439, 490

See application file for complete search history.

(56) References Cited

U.S. PATENT DOCUMENTS

| | | | |
|---|---|---|---|
| 1,579,498 | A | 4/1926 | Anderson |
| 2,629,413 | A | 2/1953 | Stettler |
| 2,635,661 | A | 4/1953 | Egan |
| 3,006,395 | A | 10/1961 | Dye |
| 3,750,729 | A | 8/1973 | Lemieux |
| 4,372,362 | A | 2/1983 | Ahn |
| 4,463,788 | A | 8/1984 | Corna et |
| 4,716,795 | A | 1/1988 | Corona et al. |
| 4,716,796 | A | 1/1988 | Corona |
| 4,762,036 | A | 8/1988 | Orlitzky et al. |
| 4,768,405 | A | 9/1988 | Nickpuck |
| 5,065,498 | A | 11/1991 | McKenzie |
| 5,228,363 | A | 7/1993 | Corona et al. |
| 5,325,745 | A | 7/1994 | Koehler |
| 5,337,637 | A | 8/1994 | Bih-Lien |
| 5,526,721 | A | 6/1996 | Waisvisz |
| 5,638,727 | A | 6/1997 | Gringer |
| 5,673,600 | A | 10/1997 | Yanagi et al. |
| 5,813,296 | A | 9/1998 | Hoff et al. |
| 5,881,615 | A | 3/1999 | Dahl et al. |

(Continued)

FOREIGN PATENT DOCUMENTS

| | | |
|---|---|---|
| CA | 2357787 | 10/2002 |
| WO | 02/064319 A1 | 8/2002 |
| WO | 02/085579 A1 | 10/2002 |

*Primary Examiner*—David B Thomas
(74) *Attorney, Agent, or Firm*—Thelen Reid Brown Raysman & Steiner LLP

(57) ABSTRACT

A screwdriver is provided having a handle having a first end and a second end; a front element having a bit holder, said front element aligned with said handle along an axis; a cylinder positioned between said handle and said front element, said cylinder having a plurality of chambers, each of said chambers shaped to store a bit; said cylinder rotatable around said axis; and a push rod having a first end and a second end, said push rod slidable along said handle from a first end of said handle to a second end of said handle, said push rod having a magnet at said first end. Wherein the second end of said push rod is positioned at said second end of said handle and said first end of said push rod is aligned with one of said chambers, moving said second end of said push rod from said second end of said handle moves said aligned bit from said cylinder to said bit holder; and when said second end of said push rod is positioned at said first end of said handle, moving said second end of said push rod to said second end of said handle moves said a bit in said bit holder to said cylinder.

7 Claims, 10 Drawing Sheets

U.S. PATENT DOCUMENTS 5,957,014 A 9/1999 Yseng et al.
6,007,277 A 12/1999 Olson et al.
6,134,995 A 10/2000 Shiao
6,138,537 A 10/2000 Cole
6,205,893 B1 3/2001 Sato
6,260,445 B1 7/2001 DeVecchis et al.
6,332,384 B1 12/2001 Cluthe
6,378,402 B1 4/2002 Kalomeris et al.
6,378,407 B1 4/2002 Purkapile
6,443,037 B1 9/2002 Chang
6,502,484 B2 1/2003 Pao-Hsi
6,511,199 B1 1/2003 Chung
6,547,470 B2 4/2003 Legg
6,601,483 B2 * 8/2003 Wannop ..... 81/490
2001/0006014 A1 7/2001 Cowart et al.
2001/0029815 A1 10/2001 Anderson
2001/0032531 A1 10/2001 Kozak et al.
2001/0033777 A1 10/2001 Peters
2002/0007705 A1 1/2002 Beauchamp
2002/0035901 A1 3/2002 Anderson
2002/0050192 A1 5/2002 Beauchamp
2002/0096024 A1 7/2002 Pao-Hsi
2002/0152850 A1 10/2002 Wannop
2002/0162429 A1 11/2002 Purkapile
2003/0029283 A1 2/2003 Yaar
2003/0079580 A1 5/2003 Beauchamp
2003/0079581 A1 5/2003 Beauchamp
2003/0084758 A1 5/2003 Chiang

* cited by examiner

MULTIPLE BIT SCREWDRIVER

CROSS-REFERENCE TO RELATED APPLICATION

This application claims priority to Canadian Application No. not yet assigned, filed on Mar. 3, 2005, entitled: "Multiple Bit Screwdriver" by Aubrey J. Rodgers.

FIELD OF THE INVENTION

This invention relates to hand tools in general, and multiple bit screwdrivers in particular.

BACKGROUND OF THE INVENTION

There are many screwdrivers available on the market that allow users to change bits so that the screwdriver can be used with various types of screws. Many of these screwdrivers allow for storage of the bits within the screwdriver so that the unused bits are easily available and are less likely to be misplaced.

Other screwdrivers not only store the bits not in use, but also allow the user to put a bit into position in the chuck without removing the bit from the screwdriver. Such screwdrivers offer additional convenience and make it difficult for the user to lose a bit. One example of such a screwdriver is disclosed in U.S. Pat. No. 6,332,384 to Cluthe.

BRIEF SUMMARY OF THE INVENTION

A screwdriver is provided with a handle having a first end and a second end; a front element having a bit holder, said front element aligned with said handle along an axis; a cylinder positioned between said handle and said front element, said cylinder having a plurality of chambers, each of said chambers shaped to store a bit; said cylinder rotatable around said axis; and a push rod having a first end and a second end, said push rod slidable along said handle from a first end of said handle to a second end of said handle, said push rod having a magnet at said first end. The second end of said push rod is positioned at said second end of said handle and said first end of said push rod is aligned with one of said chambers, so that moving said second end of said push rod from said second end of said handle moves said aligned bit from said cylinder to said bit holder; and when said second end of said push rod is positioned at said first end of said handle, moving said second end of said push rod to said second end of said handle moves said bit in said bit holder to said cylinder.

The screwdriver may have a plate positioned between said cylinder and said handle, said plate defining an opening to allow passage of said push rod. The plate may have a recess, and the cylinder may have a cavity holding a spring and a ball, said ball in contact with said plate, wherein when said cylinder is rotated and said ball is aligned with said recess, said opening is aligned with one of said chambers. The cylinder may also be transparent.

The handle may be tapered such that the second end of said handle has a smaller diameter than said first end.

The screwdriver may also include a cap positioned at said second end of said handle, the cap adapted to store a plurality of bits and an extension member.

The screwdriver may also have an internal member, said internal member having a front plate with an opening, said front plate positioned between said cylinder and said front element, said internal element also having a rear element and a tongue, said tongue adapted to guide one of said bits to said bit holder from said cylinder, said cylinder rotatable around said rear element.

DETAILED DESCRIPTION OF THE INVENTION

In the Figures, the following elements are labelled with the reference numbers according to Table 1.

TABLE 1

| ELEMENT | REFERENCE NUMBER |
|---|---|
| Screwdriver | 1 |
| Handle | 10 |
| Cylinder | 20 |
| Chamber | 22 |
| Cylinder center | 24 |
| Cavity | 26 |
| Spring | 27 |
| Ball | 28 |
| Internal member | 30 |
| Magnet | 40 |
| Bit | 50 |
| Front element | 60 |
| Screw | 70 |
| Aperture | 75 |
| Screw | 80 |
| Cap | 90 |
| Aperture | 92 |
| Cap bit holder | 94 |
| Extension member holder | 96 |
| Lip | 98 |
| Trench | 99 |
| Extension member | 100 |
| Ring screw | 102 |
| Extension member magnet | 103 |
| Ring | 104 |
| First end of extension member | 105 |
| Second end of extension member | 107 |
| Hexagonal cavity | 109 |
| Hinge | 110 |
| Hinge | 115 |
| Push Rod | 120 |
| Front Rod Member | 130 |
| Rear Rod Member | 135 |
| Spring | 140 |
| U-element | 145 |
| Ball detent | 150 |
| Plate | 160 |
| Plate opening | 165 |
| Recess | 167 |
| Rubber element | 170 |
| Slide switch | 180 |
| Bit holder | 190 |
| Channel | 200 |
| Aperture | 205 |
| Plate | 210 |
| Tongue | 220 |
| Internal Rear element | 230 |
| Opening | 240 |
| Indent | 250 |
| Aperture | 260 |
| Axis | 300 |

Figure 3:
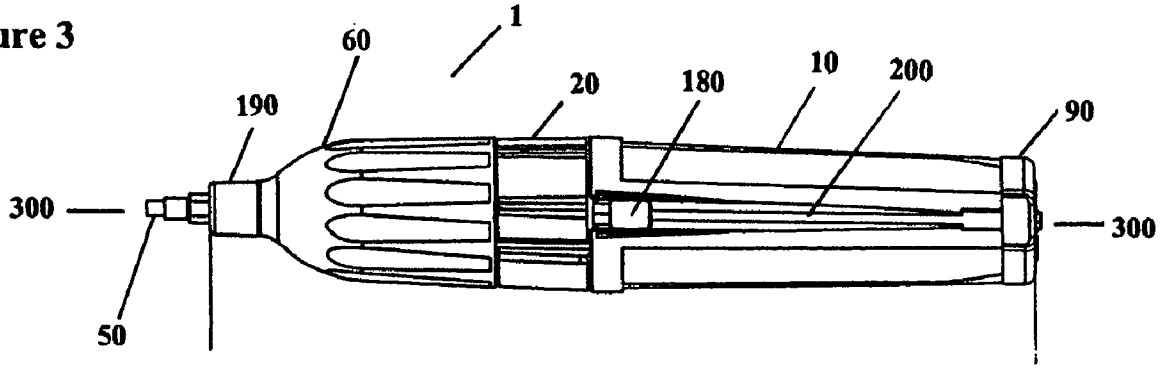
FIG. 3 is a side view of a screwdriver according to the invention.
Figure 5:
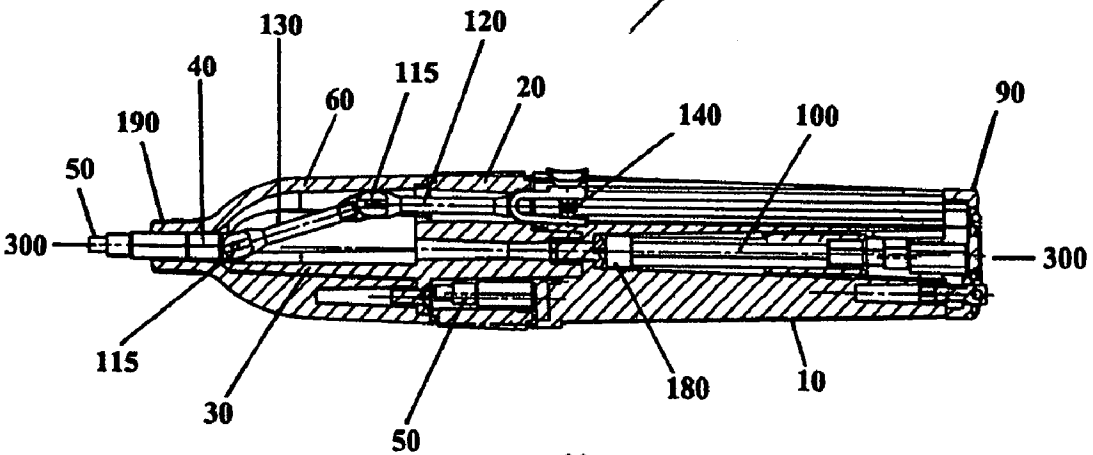
FIG. 5 is a cross-sectional side view thereof taken along the line A-A in FIG. 4.
Figure 6:
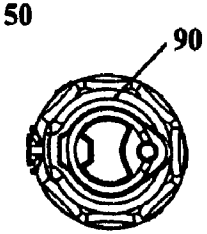
FIG. 6 is a rear view thereof.
Figure 4:
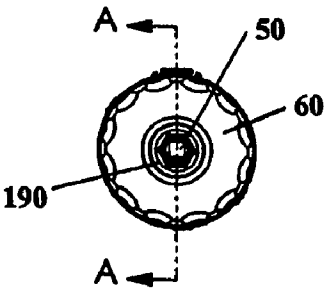
FIG. 4 is a front view thereof.
Figure 8:
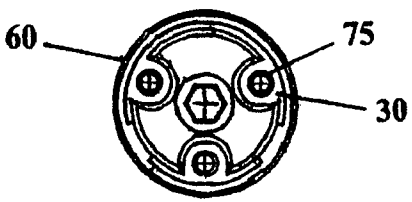
FIG. 8 is a rear view thereof.
Figure 7:
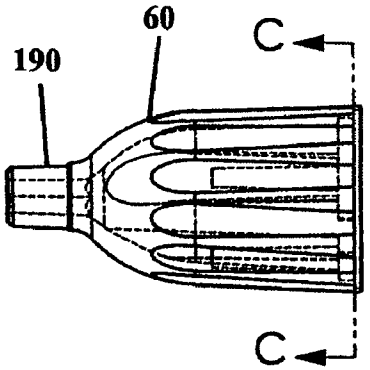
FIG. 7 is a side view of the front element of a screwdriver according to the invention.

As best seen in FIGS. 3, 5 and 6 a screwdriver 1 according to the invention has handle 10 with which the user will grip the screwdriver, rotatable cylinder 20 positioned in front of handle 10 and front element 60 on the opposite side of cylinder 20. Handle 10, cylinder 20 and front element 60 are aligned along axis 300, around which cylinder 20 can rotate.

At the rear end of screwdriver 1, at the rear end of handle 10 is cap 90. At the opposite, or front end of screwdriver 1, at the front end of front element 60, is bit holder 190, which is an aperture in front element shaped to receive and hold bit 50. Slide switch 180 is positioned on handle 10 to move within channel 200 positioned along axis 300. In this document the term "front" will be used to describe the portion of an element closest to bit holder 90. The term "rear" will be used to describe the portion of an element opposite to the front, i.e. the portion closest to cap 90.

Figure 1:
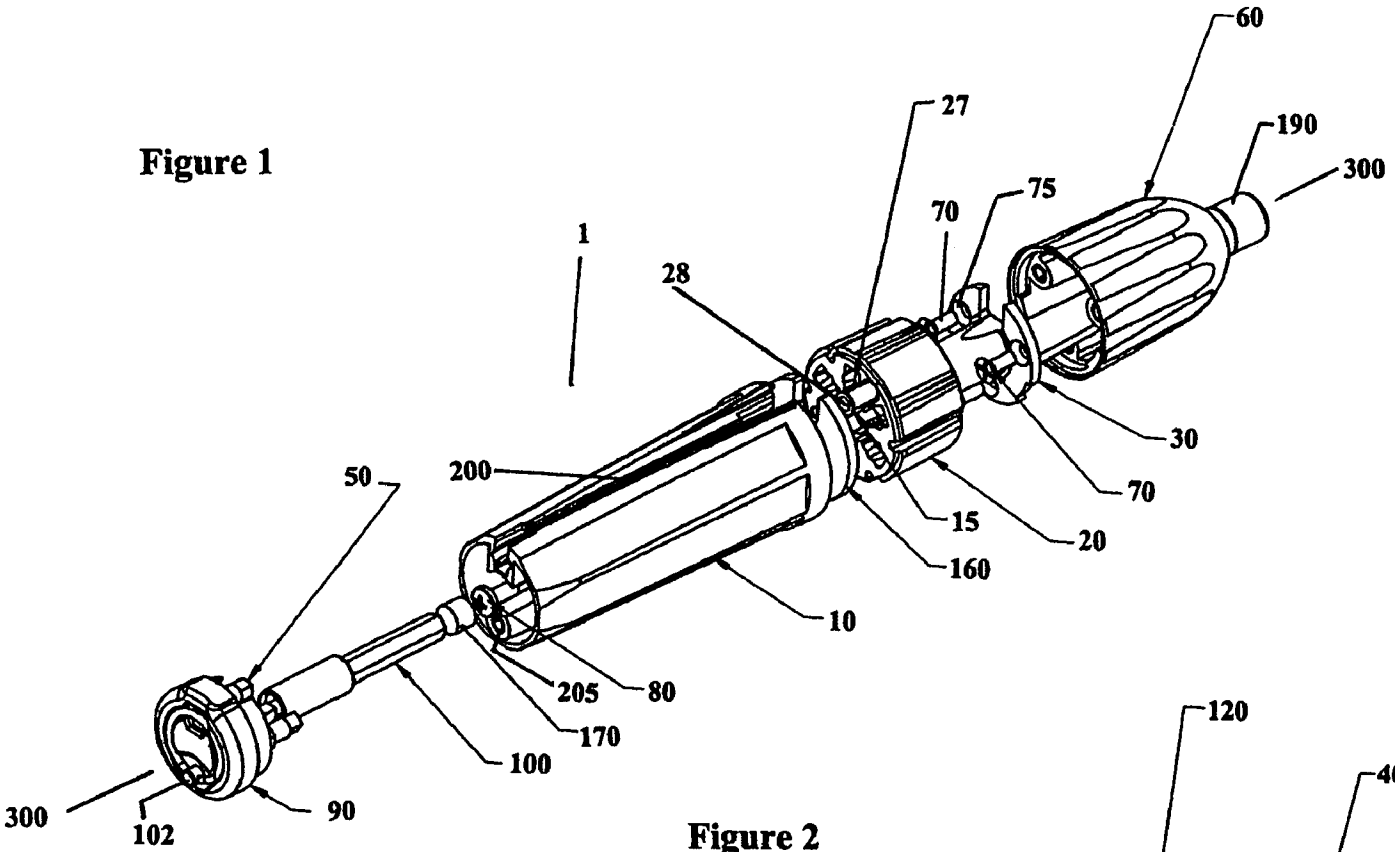
FIG. 1 is an exploded perspective view showing a screwdriver according to the invention.

With reference to FIGS. 1 and 5, within front element 60 is internal member 30. Internal member 30 is secured to front element 60 by the use of screws 70. Cylinder 20 is rotatably secured between front element 30 and plate 160. A variety of bits 50 are stored in cylinder 20. Plate 160 is secured to handle 10. Cap 90 is shaped to securely fit to handle 10. Extension member 100 and additional bits 50 may be stored within handle 10 by securing them to cap 90.

Figure 2:
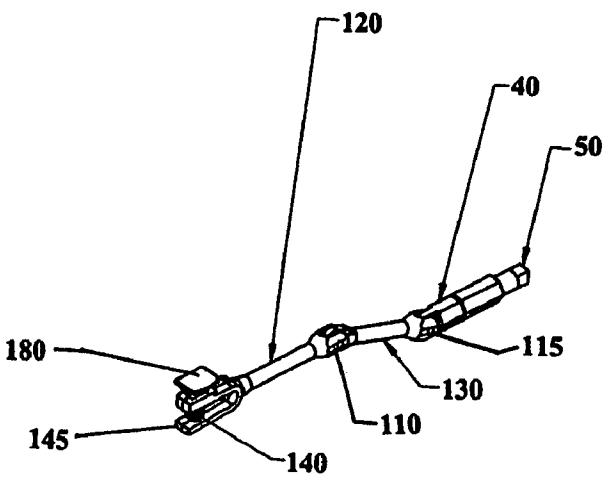
FIG. 2 is a perspective view of a push rod according to the invention.

With reference to FIG. 2, push rod 120 is used in screwdriver 1 to push bits 50 to bit holder 190 from cylinder 20 and to pull bits 50 back. Push rod 120 includes front rod member 130 and rear rod member 135. At the front end of front rod member 130 is magnet 40. Magnet 40 holds a bit 50 in place. At the rear end of rear rod member 135 is slide switch 180 and U-element 145. Spring 140 biases each end of U-element 145 apart from the other.

Front rod member 130 is pivotally secured by hinge 115 to magnet 40 at the front end of front rod member 130. Front rod member 130 is pivotally secured by hinge 110 to rear rod member 135 at the rear end of front rod member.

Figure 11:
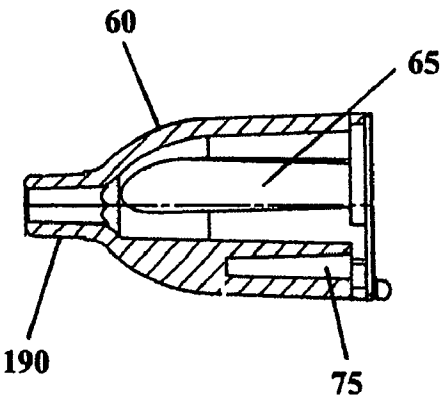
FIG. 11 is a cross sectional side view taken along line A-A in FIG. 9.
Figure 10:
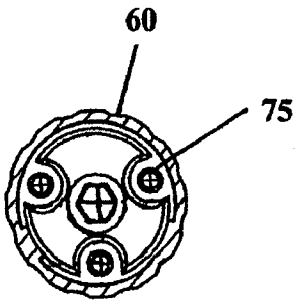
FIG. 10 is a cross sectional rear view thereof taken along the line C-C in FIG. 7.
Figure 9:
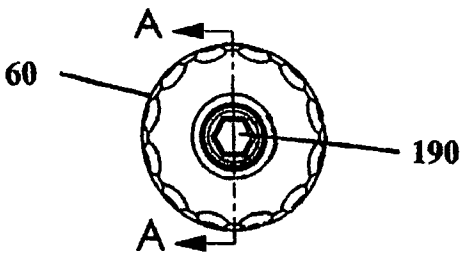
FIG. 9 is a front view thereof.
Figure 12:
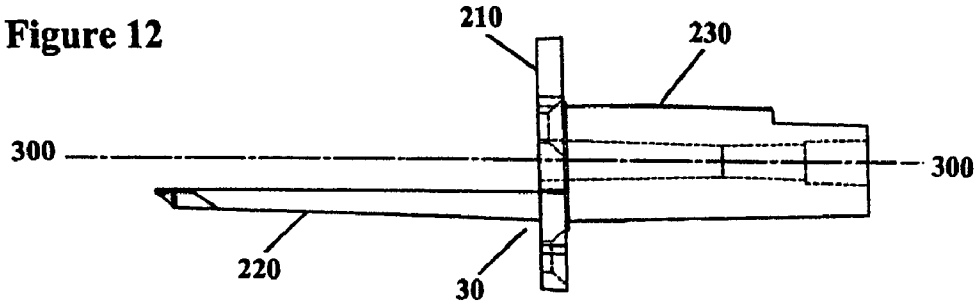
FIG. 12 is a side view of an internal element of a screwdriver according to the invention.
Figure 14:
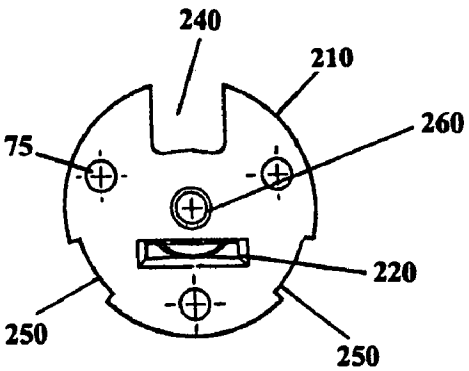
FIG. 14 is a front view thereof.
Figure 16:
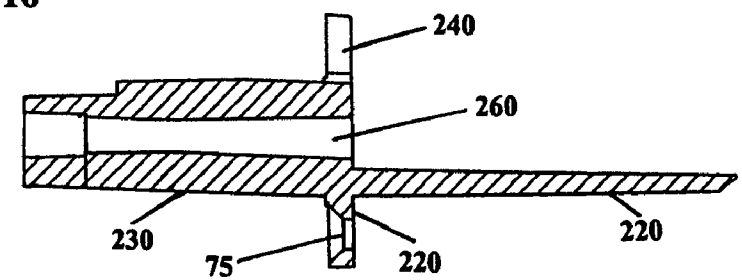
FIG. 16 is a cross sectional side view taken along line A-A in FIG. 15.
Figure 13:
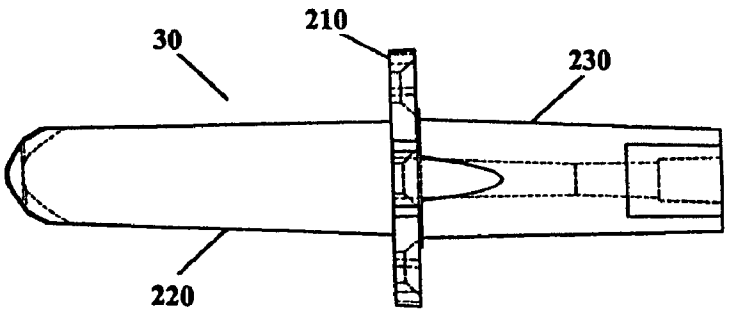
FIG. 13 is a top view thereof.
Figure 15:
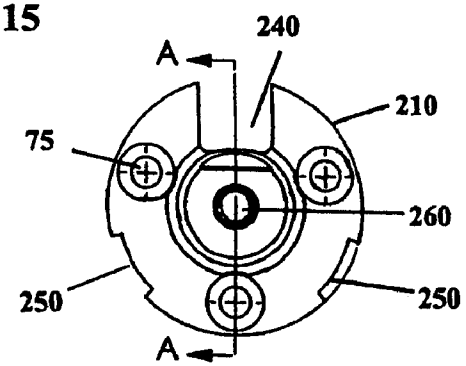
FIG. 15 is a rear view thereof.
Figure 18:
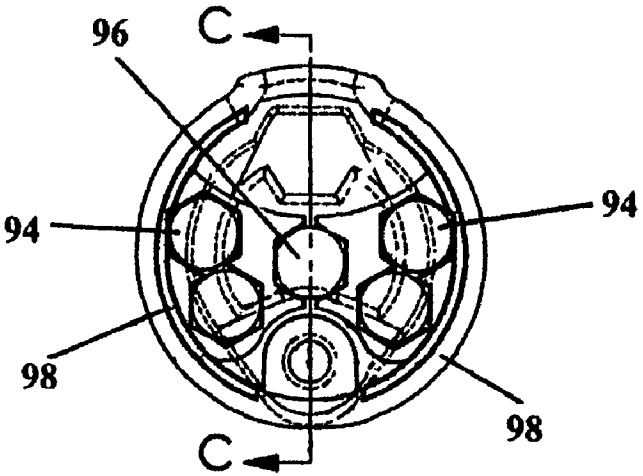
FIG. 18 is a front view thereof.
Figure 20:
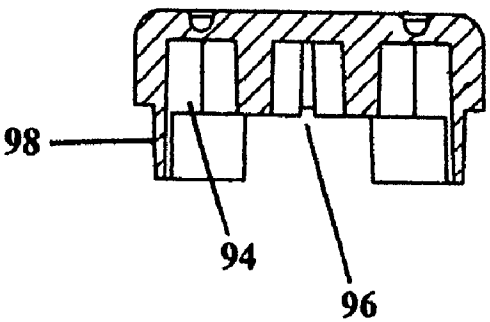
FIG. 20 is a cross sectional side view thereof taken along line C-C in FIG. 18.
Figure 17:
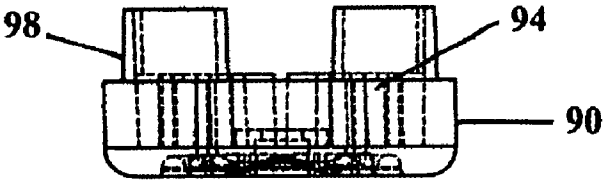
FIG. 17 is a side view of an end cap of a screwdriver according to the invention.
Figure 19:
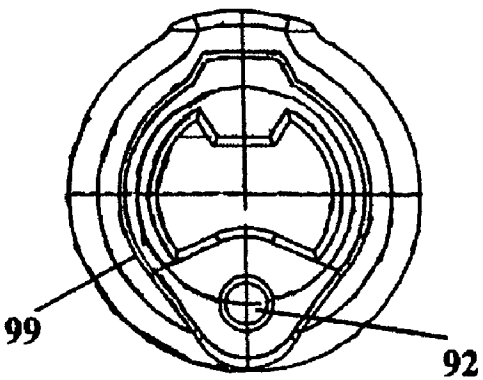
FIG. 19 is a rear view thereof.

FIGS. 7, 8, 9, 10 and 11 show a preferred embodiment of a front element according to the invention. Front element 60 includes bit holder 190, which is shaped to receive the hexagonal end of bit 50 (although other shapes can be used). Apertures 75 at the rear end of front element 60 are shaped to receive screws 70 to secure front element 60 to internal member 30. Front element 60 defines channel 65 as seen in FIG. 11 through which push rod 120 can pass to position bit 50 in bit holder 190. Channel 65 is shaped to receive tongue 220 of internal member 30. Channel 65 is gently curved to allow magnet 40 and front rod member 130 to pivot as necessary on hinge 110 to position bit 50.

FIGS. 12, 13, 14, 15 and 16 show a preferred embodiment of an internal member according to the invention. Internal member 30 generally includes plate 210, tongue 220, and internal rear element 230. Tongue 220 is shaped to be received by channel 65 of front element 60. Plate 210 is sized to fit snugly into the rear portion of front element 60. Plate 210 defines opening 240. Opening 240 is sized to allow a bit 50 within cylinder 20 to pass through plate 210 and into front portion 60. Apertures 75 in plate 210 receive screws 70 to secure internal member 30 to front element 60. Internal rear element 230 is shaped to hold cylinder 20 in position while allowing cylinder 30 to rotate around rear element 230 and axis 300.

FIGS. 17, 18, 19, 20 and 21 show a preferred embodiment of a cap according to the invention. Cap 90 defines aperture 92 to allow ring screw 102 to pass through and secure cap 90 to handle 10. Cap 90 can also be used to store extra bits 50 and extension member 100 (as seen in FIG. 1) within handle 10. On front end of cap 90 are a plurality of cap bit holders 94. Cap bit holders 94 are shaped to snugly receive and detachably secure extra bits 50. Extension member holder 96 is centrally located on the front side of cap 90 to snugly receive and detachably secure extension member 96. Extension member holder 96 and cap bit holders 94 are hexagonally shaped to snugly fit extension member 100 and extra bits 50. The rear side of cap 90 has trench 99 in which to position ring 104 of ring screw 102.

Figure 21:
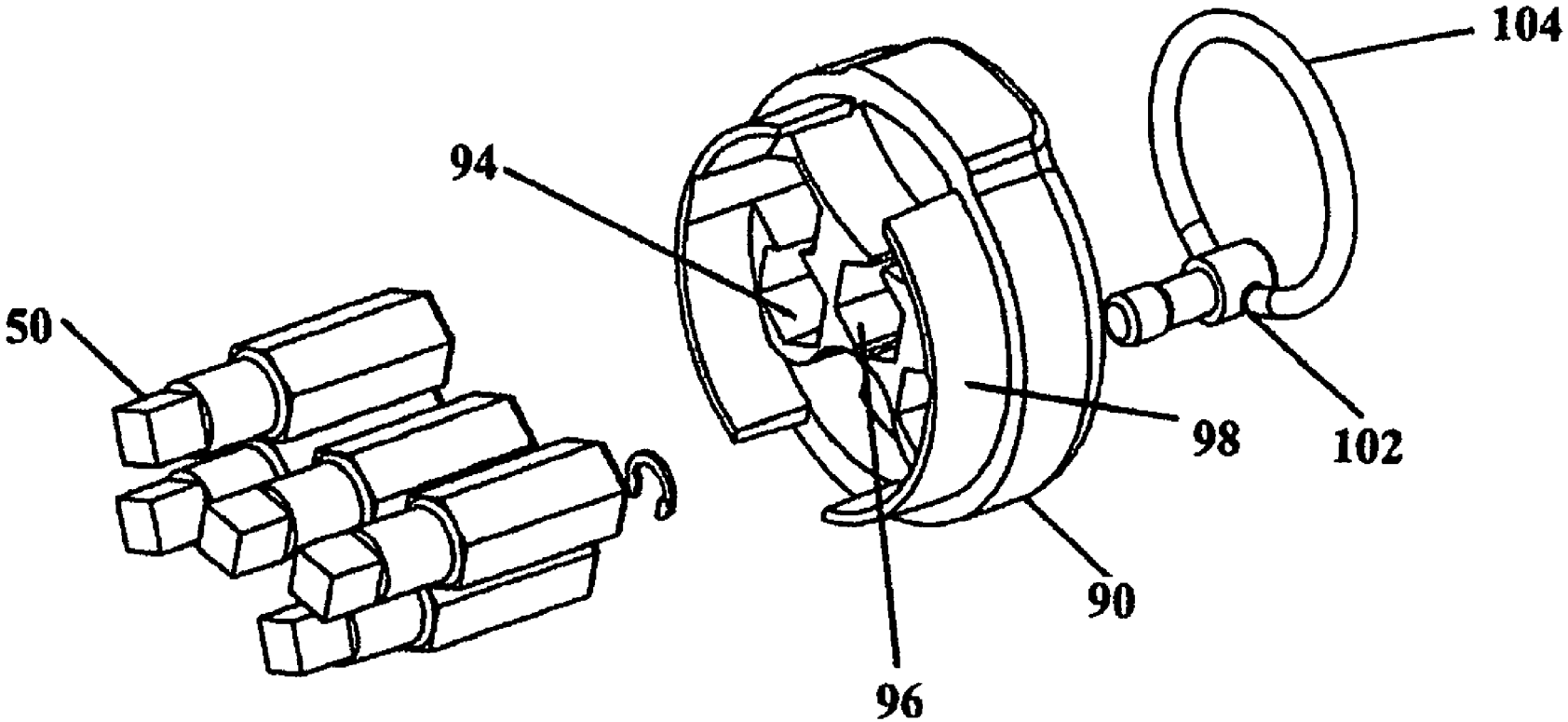
FIG. 21 is a perspective view thereof showing the alternative bits.
Figure 23:
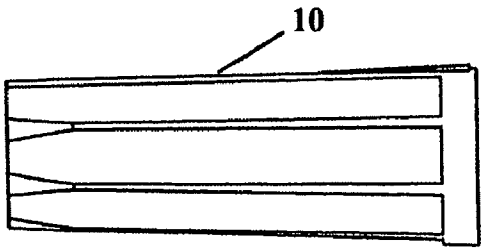
FIG. 23 is a side view thereof.
Figure 26:
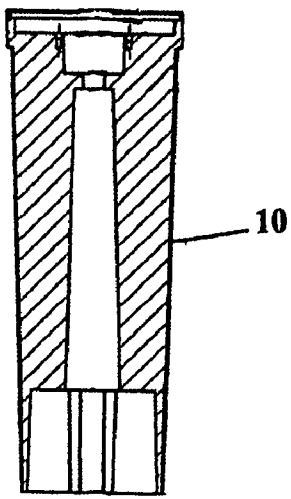
FIG. 26 is a cross sectional side view taken along D-D.
Figure 25:
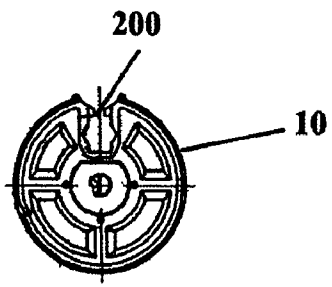
FIG. 25 is a rear view thereof.
Figure 22:
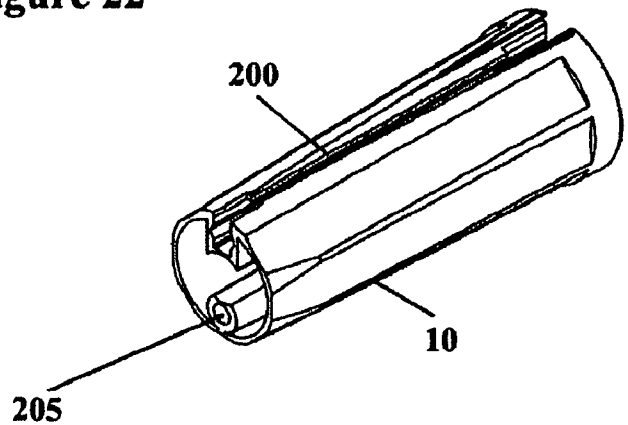
FIG. 22 is a perspective view of the screwdriver handle according to the invention.
Figure 24:
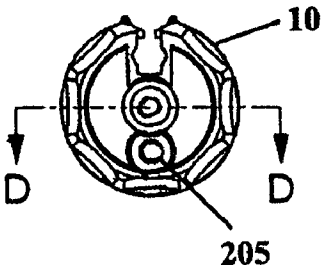
FIG. 24 is a front view thereof.

Cap bit holders 94 are preferably the same size as extension member holder 96 so that an extra bit 50 (as seen in FIG. 21) can be stored in extension member holder 96 if extension member 100 is not needed. The front side of cap 90 also has lips 98 to help hold extra bits 50 in place and to help secure cap 90 to handle 10.

FIGS. 22, 23, 24 and 25 show a preferred embodiment of a handle according to the invention. The exterior of handle 10 is preferably generally hexagonal and sized for easy gripping by a user. Channel 200 runs along a side of handle 10 parallel to axis 300. Channel 200 is adapted to allow push rod 120 to enter and exit channel 200 at front end of handle 10. Push rod 120 is sized such that when slide switch 180 is positioned at the rear of handle 10, magnet 40 will be positioned just below cylinder 20. Slide switch 180 is sized to be too large to pass into channel 200. Channel 200 broadens at each of front end and rear end of handle 10. The broadened portion of channel 200 causes spring 140 to bias one end of U-element 145 upward, causing slide switch 180 to be locked into place at either end of handle 10. To release slide switch 180, pressure must be placed downwardly, pushing down the U-element 145 and allowing slide switch 180 to move along channel 200. Channel 200, at its rear end includes aperture 205 to receive ring screw 102.

Handle 10 tapers so that has a greater diameter at its front end than at its rear end. This provides gripping advantages in that a user's fingers are more likely to be aligned.

Figure 28:
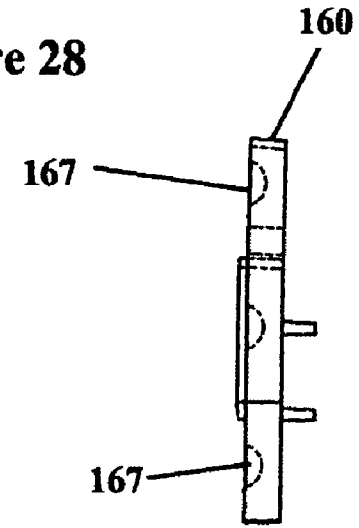
FIG. 28 is a side view thereof.
Figure 29:
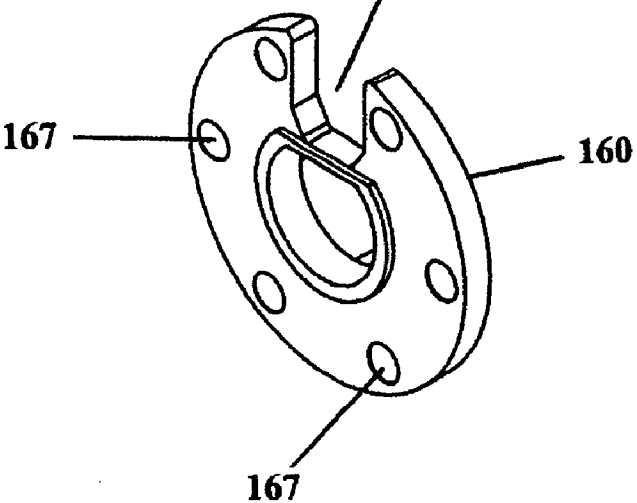
FIG. 29 is a perspective view thereof.
Figure 27:
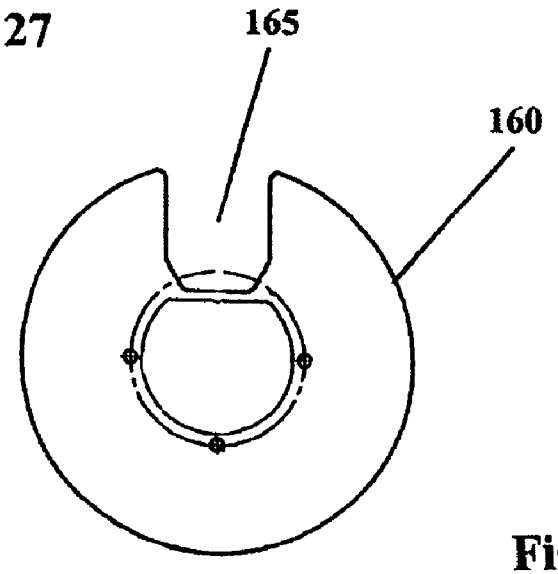
FIG. 27 is a front view of a plate in a screwdriver according to the invention.

FIGS. 27, 28 and 29 show a preferred embodiment of a plate according to the invention. Plate 160 defines plate opening 165 through which push rod 120 can pass through. Plate opening 165 is sized to allow push rod 120 to completely pass through when push rod 120 is aligned with a chamber 22 of cylinder 20. Plate 160 is positioned between cylinder 20 and handle 10. In an alternative embodiment of plate 160, extending members may help secure plate 160 to handle 10. Plate 160 includes radially positioned recesses 167 shaped to receive ball 28.

Figure 31:
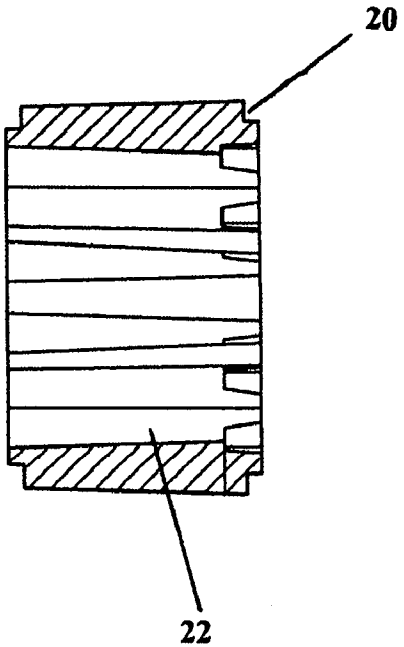
FIG. 31 is a side view thereof.
Figure 30:
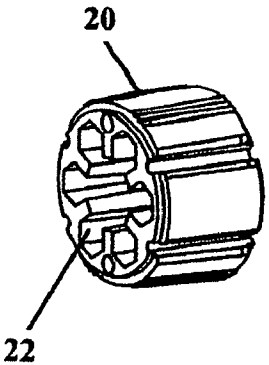
FIG. 30 is a perspective view of a cylinder in a screwdriver according to the invention.
Figure 32:
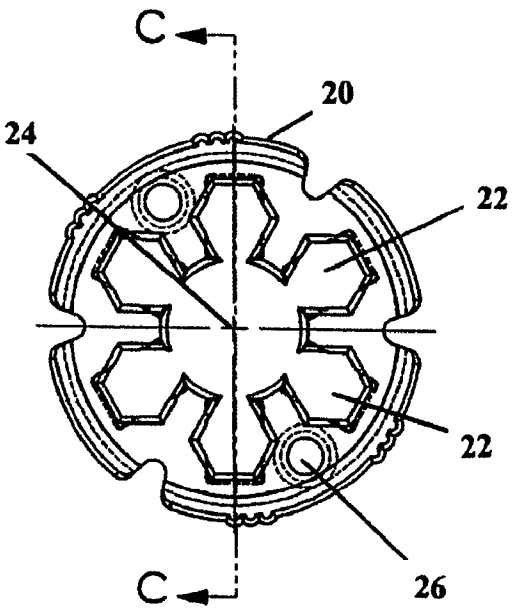
FIG. 32 is a front view thereof.

FIGS. 30, 31 and 32 show a preferred embodiment of a cylinder according to the invention. Cylinder 20 defines a plurality of chambers 22. Chambers 22 are positioned radially around the center 24 of cylinder 20 and are sized to store a bit 50. The center 24 of chamber 22 defines an aperture sized to fit around internal member 30 so that cylinder 20 can be rotated. Each chamber 22 is accessible from the front and rear ends to allow push rod 120 inside chamber 22 to push bit 50 to bit holder 190 and allow push rod 120 to pull bit 50 back into chamber 22. Cylinder 20 is made of a transparent material so that a user can see inside chambers 22 in order to select a bit 50.

Cylinder 20 also has a plurality of cavities 26 positioned radially around cylinder 20 between chambers 22. Cavities 26 are open from the rear end of cylinder 20 and are closed at the front end. There may be as few as one cavity 26, or two as seen in FIGS. 30 and 32, or six or more. As seen in FIG. 1, cavity 26 is sized to receive spring 27 which biases ball 28 towards the rear of cylinder 20. When cylinder 20 is rotated, ball 28 rolls along plate 160 until encountering a recess 167 on plate 160. Recesses 167 and cavities 26 are positioned such that when a recess 167 is aligned with a cavity 26, a chamber 22 will be aligned with opening 165 and push rod 120. This allows a user to easily align chambers 22 with push rod 120.

Figure 34:
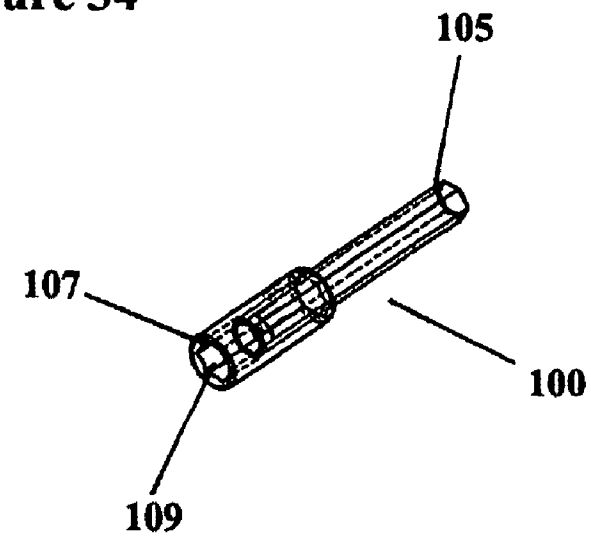
FIG. 34 is a perspective view thereof.
Figure 33:
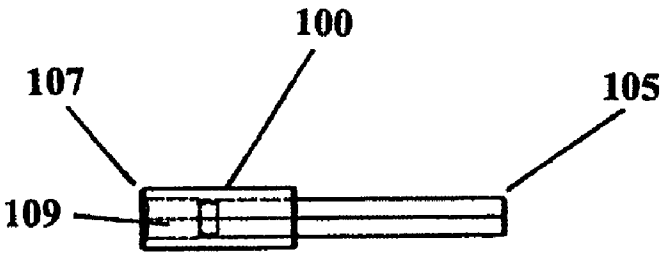
FIG. 33 is a side view of an extension member for a screwdriver according to the invention.

FIGS. 33 and 34 show a preferred embodiment of an extension member according to the invention. Extension member 100 is shaped such that first end 105 can detachably secure to bit holder 190. First end is preferably hexagonally shaped to be received by bit holder 190. Second end 107 includes a hexagonal cavity 109 shaped to receive a bit 50. Preferably magnet 103 is positioned within hexagonal cavity 109 to retain bit 50.

In use, slide switch 180 is normally maintained at the rear end of screwdriver 1, so that no bit 50 is in place in bit holder 190. Once the screwdriver is to be used, the user rotates cylinder 20 to align the appropriate bit 50 in a chamber 22 with channel 200. Once selected bit 50 is aligned with channel 20, the user slides slide switch 180 along channel 200. This causes push rod 120 to push bit 50 out of cylinder 20 and into front element 60 and then into bit holder 190.

Once the user has finished with the particular bit 50, user moves slide switch 180 along channel 200 towards the rear end of handle 10. Magnet 40 pulls bit 50 with push rod 120 into chamber 22 of cylinder 20. At this point, the user can select a different bit 50 by rotating the cylinder 20.

In cases where the user must reach a screw or other connecting device and requires more reach than is available with screwdriver 1, the user can remove cap 90 by unscrewing ring screw 102, and place the first end 105 of extension member 100 into bit holder 190. The user can then place a bit 50 into extension member cavity 109 where it will be held in place by extension member magnet 103.

Although the particular preferred embodiments of the invention have been disclosed in detail for illustrative purposes, it will be recognized that variations or modifications of the disclosed apparatus lie within the scope of the present invention.

The invention claimed is:

1. A screwdriver comprising:

a handle having a first end and a second end;

a front element having a bit holder, said front element aligned with said handle along an axis;

a cylinder positioned between said handle and said front element, said cylinder having a plurality of chambers, each of said chambers shaped to store a bit; said cylinder rotatable around said axis;

a push rod having a first end and a second end, said push rod slidable along said handle from a first end of said handle to a second end of said handle, said push rod having a magnet at said first end, said push rod having a hinge; and a plate positioned between said cylinder and said handle, said plate defining an opening to allow passage of said push rod, wherein when said second end of said push rod is positioned at said second end of said handle and said first end of said push rod is aligned with one of said chambers, movement of said second end of said push rod from said second end of said handle moves said aligned bit from said cylinder to said bit holder, further wherein when said second end of said push rod is positioned at said first end of said handle, movement of said second end of said push rod to said second end of said handle moves said bit in said bit holder to said cylinder.

2. The screwdriver of claim 1, wherein said plate has a recess, and said cylinder has a cavity holding a spring and a ball, said ball in contact with said plate, wherein when said cylinder is rotated and said ball is aligned with said recess, said opening is aligned with one of said chambers.

3. The screwdriver of claim 2 wherein said handle is tapered such that the second end of said handle has a smaller diameter than said first end.

4. The screwdriver of claim 3 wherein said cylinder is transparent.

5. The screwdriver of claim 4 further comprising a cap positioned at said second end of said handle, said cap adapted to store a plurality of bits.

6. The screwdriver of claim 5 wherein said cap is further adapted to store an extension member.

7. The screwdriver of claim 6 further comprising an internal member, said internal member having a front plate with an opening, said front plate positioned between said cylinder and said front element, said internal element also having a rear element and a tongue, said tongue adapted to guide one of said bits to said bit holder from said cylinder, said cylinder rotatable around said rear element.

* * * * *